US005127691A

United States Patent [19]

Herron et al.

[11] Patent Number: 5,127,691

[45] Date of Patent: Jul. 7, 1992

[54] STRIKE WITH RECTILINEARLY MOVABLE KEEPER LOCKING MEMBER

[75] Inventors: William L. Herron, Elizabeth; Wolfgang Jaffe, Villas, both of N.J.

[73] Assignee: Trine Products Corp., Bronx, N.Y.

[21] Appl. No.: 639,801

[22] Filed: Jan. 10, 1991

Related U.S. Application Data

[63] Continuation-in-part of Ser. No. 555,358, Jun. 8, 1990, Pat. No. 4,984,835, which is a continuation of Ser. No. 289,216, Dec. 23, 1988, abandoned.

[51] Int. Cl.[5] ..... E05C 19/16

[52] U.S. Cl. ..... 292/341.16; 292/144

[58] Field of Search ..... 292/341.16, 144, 201, 292/207, 341.15

[56] References Cited

U.S. PATENT DOCUMENTS

| | | | |
|---|---|---|---|
| 3,040,555 | 6/1962 | Wartian | 292/198 |
| 4,056,277 | 11/1977 | Gamus et al. | 292/341.16 |
| 4,896,909 | 1/1990 | Mauer | 292/341.16 |
| 4,984,835 | 1/1991 | Vadacchino et al. | 292/341.16 |

FOREIGN PATENT DOCUMENTS

| | | | |
|---|---|---|---|
| 49215 | 11/1888 | Fed. Rep. of Germany | 242/341.16 |
| 72501 | 4/1893 | Fed. Rep. of Germany | 292/341.16 |
| 1026193 | 3/1958 | Fed. Rep. of Germany | 292/341.16 |
| 206324 | 11/1959 | Fed. Rep. of Germany | 242/341.17 |

*Primary Examiner*—Eric K. Nicholson

*Attorney, Agent, or Firm*—Brooks Haidt Haffner & Delahunty

[57] ABSTRACT

An electrically operable strike with a pivotable keeper and a rectilinearly slidable locking member with planar major surfaces with arms extending parallel to the surface planes, which arms in one position of the locking member prevent pivoting of the keeper and which in a second, different position of the locking member, permit the keeper to pivot. The locking member has a magnetic portion and is moved from one position to the other by the magnetic field of an electrically energizable coil having its axis perpendicular to the plane of movement of the locking member. There are two similar locking members, and with one locking member, the strike is normally locked and by replacing such locking member by the other locking member, the strike is normally unlocked. In one embodiment, the keeper engages faces of the locking member arms and in another embodiment, the keeper engages faces at the ends of the locking member arms. By inverting the strike and moving the coil to the opposite end of the strike, the "hand" of the strike can be changed.

15 Claims, 5 Drawing Sheets

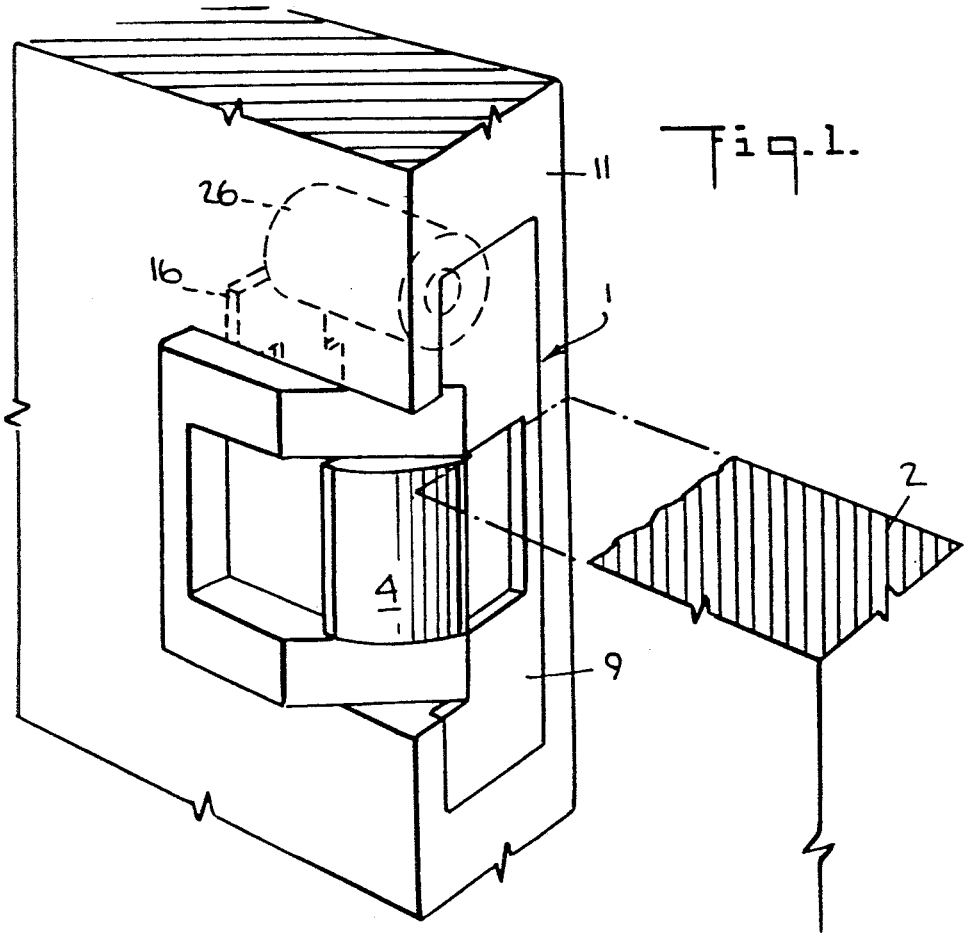
Fig. 1.
Fig. 11.
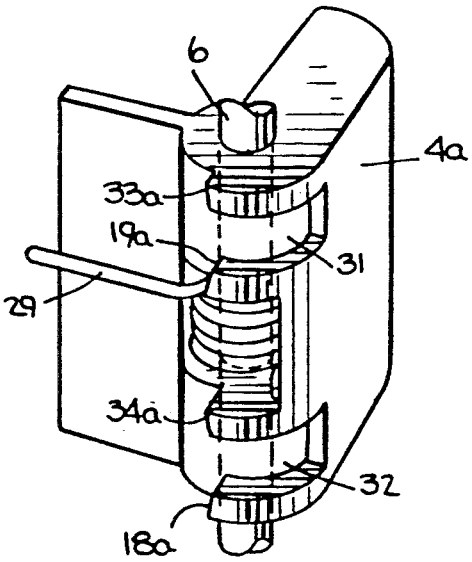
Fig. 12.
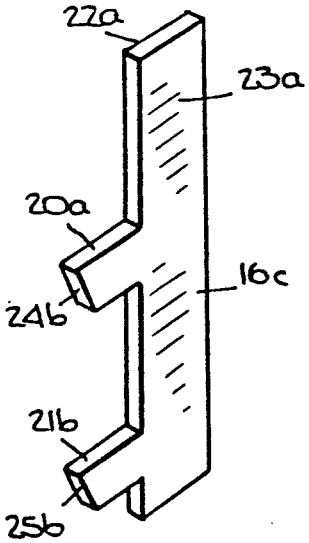
Fig. 13.
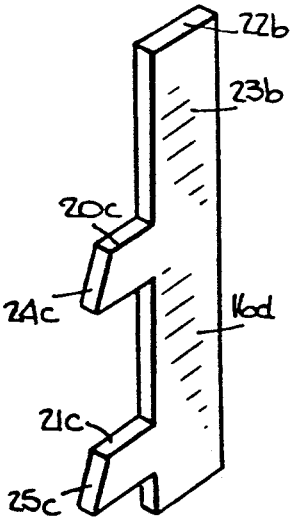

Fig. 4.
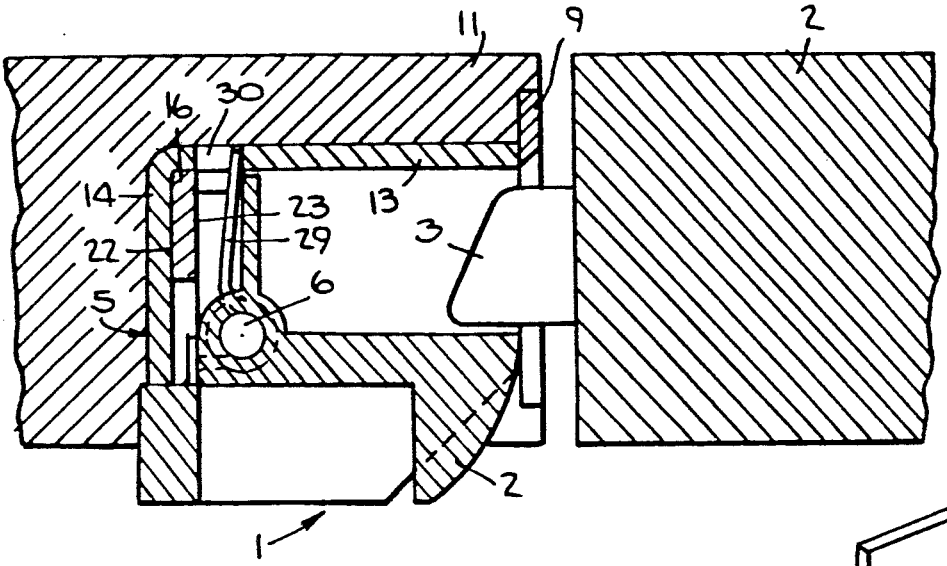
Fig. 10.
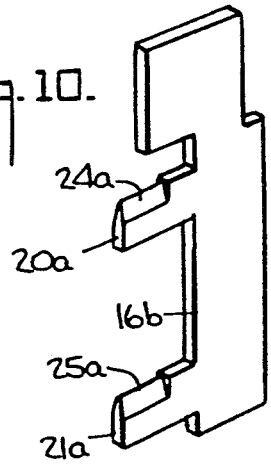
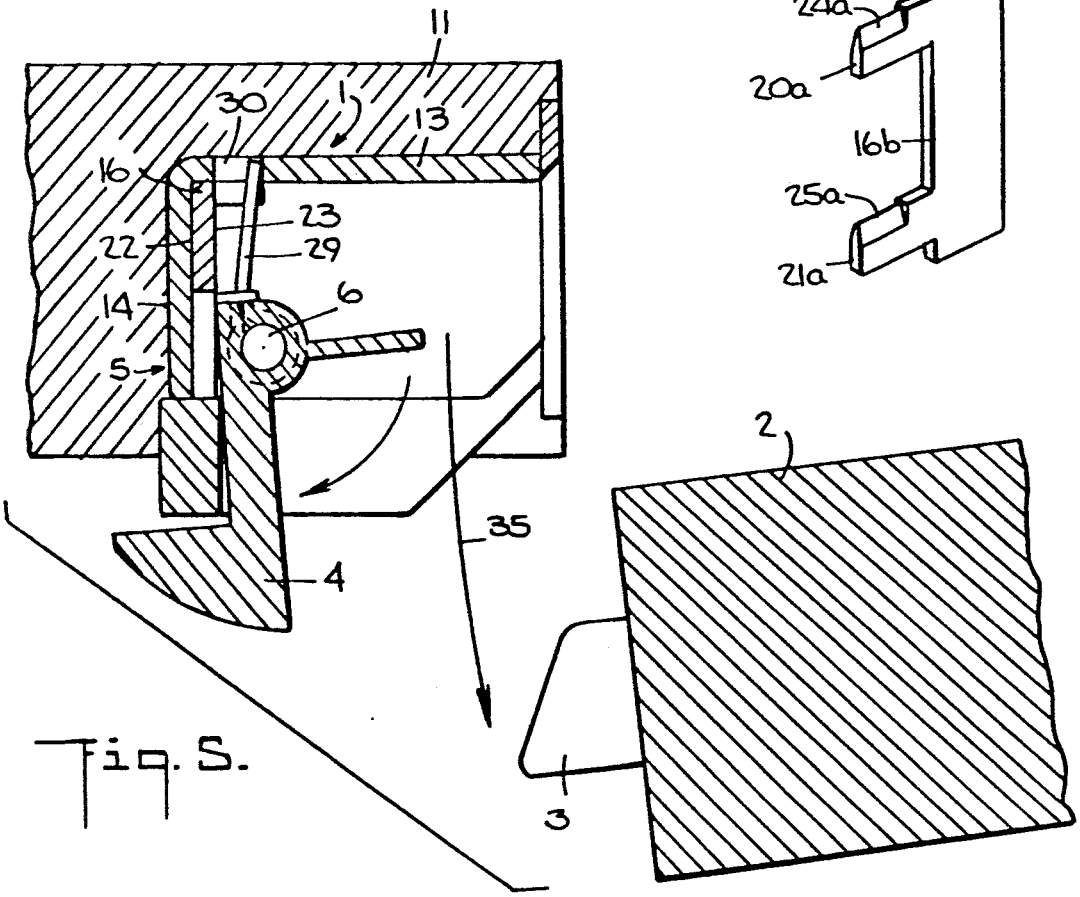
Fig. 5.

STRIKE WITH RECTILINEARLY MOVABLE KEEPER LOCKING MEMBER

RELATED APPLICATIONS

This application is a continuation-in-part of application Ser. No. 07/555,358, filed Jun. 8, 1990 now U.S. Pat. No. 4,984,835, which is a continuation of application Ser. No. 289,216 filed Dec. 23, 1988, now abandoned, and both, entitled Strike With Rectilinearly Movable Keeper Locking Member, the disclosures of which are incorporated herein by reference.

FIELD OF THE INVENTION

The invention relates to a strike used to prevent the opening of an associated access obstructing member, such as a door.

BACKGROUND OF THE INVENTION

Electrically operable strikes are well known in the art, and for example, they are used frequently in connection with the main access door of an apartment building to prevent entry into the building until a solenoid associated with the strike is electrically energized to permit pivoting of the strike keeper. See, for example, U.S. Pat. Nos. 4,471,983; 3,638,984 and 3,749,435. Normally, the solenoid is energized by means of a circuit completing switch remote from the strike.

It is also known in the art to prevent release of the latch or keeper of the strike and opening of the door by electrically energizing the solenoid. However, usually there are substantial differences between the components of a strike which will release the keeper with energization of the solenoid and the components of a strike which will lock the keeper with energization of the solenoid.

In addition, the known strikes usually require several components, such as pivotable levers, etc. which increases the assembly problems and the likelihood of malfunctioning because of misalignment, binding or corrosion. Also, if opening force is being applied to the door, the solenoid generally will be unable to cause release of the keeper and/or the components may be unable to prevent opening of the door if a sufficient opening force is applied to the door due to breaking or bending of the locking components.

In general, prior art strikes comprise a single solenoid which has a winding of a conductor which, when electrically energized, actuates an armature which has a locking member connected thereto and biassed by a spring so that the locking member prevents pivoting of the keeper unless the solenoid is electrically energized. To keep the energizing current low, the biassing spring usually has a force which is only slightly more than the force required to return the locking member and the armature to their locking or unlocking positions. Such spring return force may, at times, such as with misalignment of parts, accumulation of foreign matter, etc., be insufficient to return them to their unlocking or locking positions.

It is also known in the art to use an air actuated piston and cylinder assembly with the piston connected to the locking member to actuate the locking member.

OBJECTS OF THE INVENTION

One object of the invention is to provide a strike of ed construction and which is simpler to manufacture than the strike described in said application Ser. No. 07/555,358 now U.S. Pat. No. 4,984,835.

Another object of the invention is to provide a strike which, by simple replacement of the locking member, permits the strike to be changed from locking of the keeper with energization of the actuating means to unlocking of the keeper with energization of the actuating means.

Another object of the invention is to provide a strike construction which requires a force to break the locking member which is greater than the force required to break prior art locking mechanisms.

Another object of the invention is to provide a strike which by inversion of the strike housing and the locking member and remounting of the actuating solenoid, the "hand" of the strike can be changed from left hand to right hand and vice versa.

Another object of the invention is to reduce the exterior dimensions of a strike as compared to the exterior dimensions of the strike disclosed in said application Ser. No. 07/555,358 now U.S. Pat. No. 4,984,835.

Another object of the invention is to provide a strike in which the locking member can be returned to its normal position, that is, the position which it assumes in the absence of energization of the solenoid, without a spring.

Another object of the invention is to provide a strike construction in which the locking member can be moved by the actuating means even if substantial force is applied to the keeper.

A further object of the invention is to provide a strike with an electromagnet and improved magnetic circuit for the electromagnet so that the locking member operating force for a given amount of electrical current is greater than in prior art strikes.

Other objects of the invention are to make assembly of the strike less critical.

BRIEF SUMMARY OF THE INVENTION

The objects of the invention are attained in the preferred embodiment of the invention by pivotally mounting a keeper on a housing, such keeper having a pair of locking member engaging surfaces extending in planes at a slight angle to the pivot axis, and by slidably mounting a locking member of magnetic material and having arms with side surfaces which are engageable and mate with or are spaced from such surfaces on the keeper depending on the position of the locking member. The keeper is urged into its locking position by a spring, and the locking member is urged into the desired normal position locking or unlocking, by gravity although a spring of light force can be used to aid the force of gravity. The locking member bears against the housing so that any force applied thereto by the keeper is transmitted to a wall of the housing. An electromagnet coil on the housing with its axis perpendicular to the direction of movement of the locking member attracts the locking member, causing it to move rectilinearly, when the coil is electrically energized.

In another embodiment of the invention, the keeper has locking member engaging surfaces lying in planes perpendicular to the keeper pivot axis, and the locking member has corresponding mating surfaces.

In both embodiments the locking member can have parallel and planar major surfaces and can be die cut from metal plate stock.

BRIEF DESCRIPTION OF THE DRAWINGS

Other objects and advantages of the present invention will be apparent from the following detailed description of the presently preferred embodiments thereof, which description should be considered in conjunction with the accompanying drawings in which:

FIG. 1 is a perspective view of an embodiment of a normally locked, electrically operable strike mounted on a door frame and a portion of a door controlled thereby;

FIGS. 4 and 5 are bottom, cross-sectional views of the strike shown in FIG. 1 which, respectively, illustrate the keeper in its locked and unlocked positions;

FIG. 10 is a perspective view of the locking member used in the embodiment shown in FIGS. 8 and 9;

FIG. 11 is a perspective view of an alternate embodiment of a keeper which can be used in the strike of the invention; and FIGS. 12 and 13 are perspective views of locking members used with the keeper illustrated in FIG. 11.

With reference to FIGS. 1-5, the preferred embodiment of the electrically operable strike 1 of the invention is illustrated in FIG. 1 as mounted in a recess of a door frame 11 associated with a door 2 having a spring biassed latch 3 engaging a keeper 4 of the strike 1. The keeper 4 is pivotally mounted on the housing 5 by means of a pin or rod 6 received at one end in an opening in a bottom wall 7 and, at its opposite end, in an opening in the top wall 8 of the housing 5, the keeper 4 being pivotable around axis of the pin 6. The housing 5 is secured by screws 5*a* and 5*b* to the face plate 9 having tabs 10*a* and 10*b* integral therewith for securing it to the door frame 11, such as by means of the screws 12.

Figure 2:
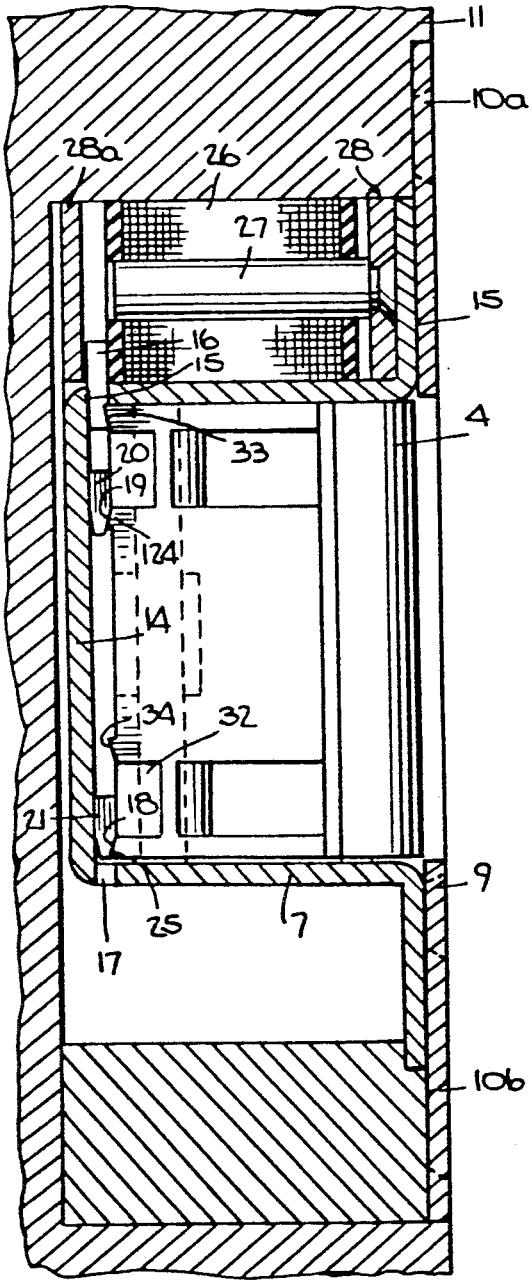
FIGS. 2 and 3 are, respectively, side cross-sectional and front elevation views of the strike shown in FIG. 1.

The housing 5 has a side wall 13 and a rear wall 14. The top wall 8 has a slot 15 (see FIG. 2) for receiving an end of a slidable locking member 16, and the bottom wall 7 has a slot 17 for purposes hereinafter described.

Figure 6:
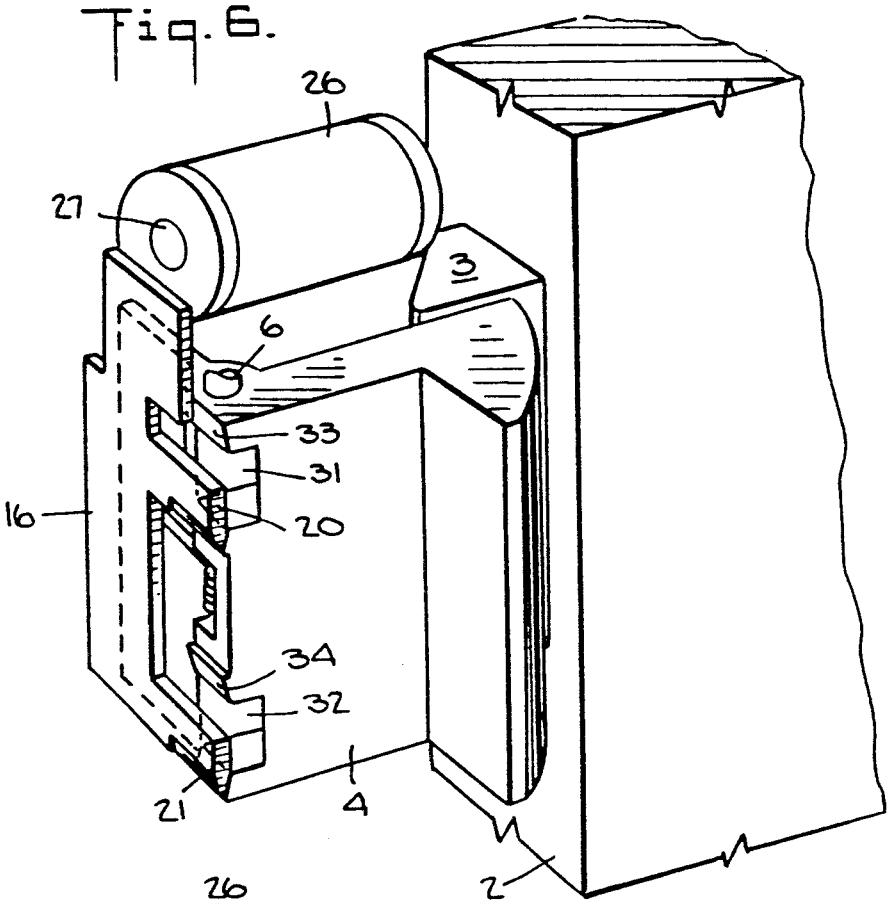
FIGS. 6 and 7 are perspective views corresponding to FIGS. 4 and 5, respectively, but with parts removed for ease in illustration.
Figure 7:
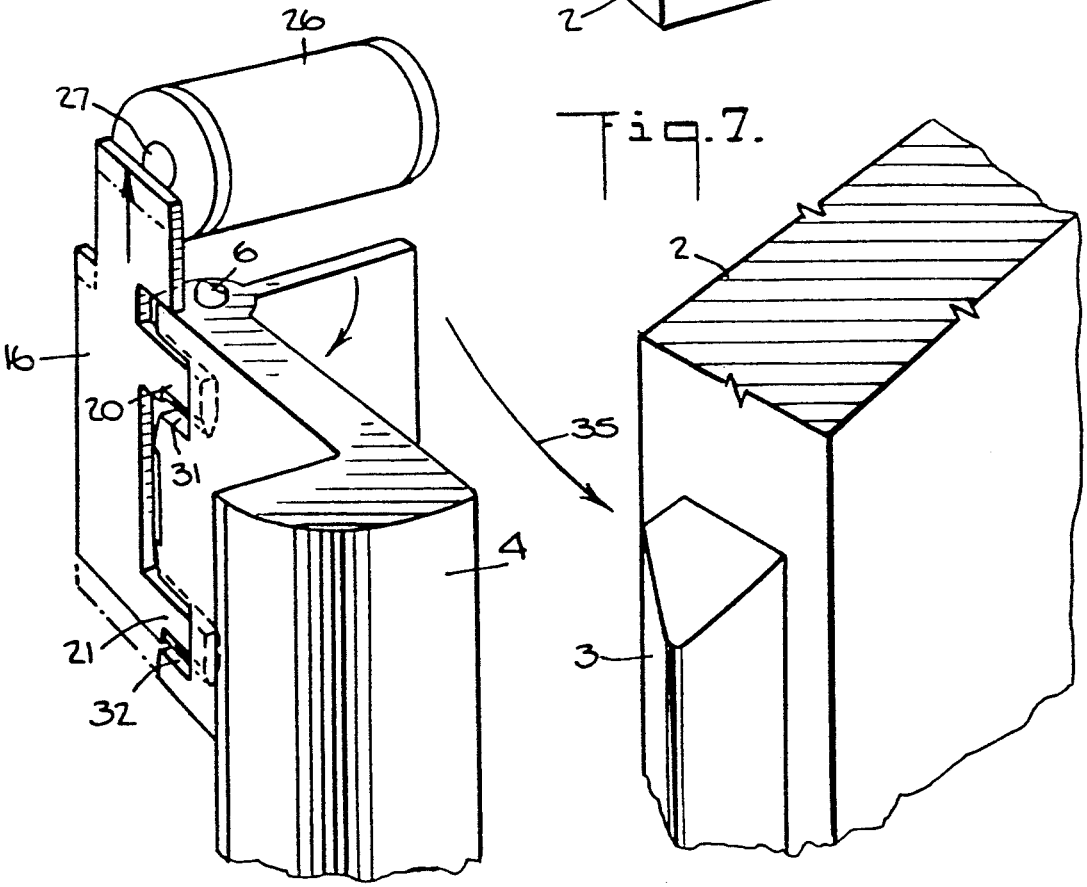

As can be seen in FIGS. 2, 6 and 7, the keeper 4 has, at the rear thereof, a pair of faces 18 and 19 lying in planes extending at a small angle in the range from 10° to 15°, e.g. 12° to the pivot axis of the keeper 4. The faces 18 and 19 are spaced apart in the direction of said axis by a predetermined distance, and although the faces 18 and 19 can be in plane parallel to said axis, for the reasons set forth hereinafter, the faces 18 and 19, preferably, lie in planes extending at a small angle to said axis as shown. As used herein, the term "substantially parallel" is intended to include parallel or at an angle not greater than about 15°.

The locking member 16 (see particularly FIGS. 2 and 4) is slidably mounted in the housing 5 and bears against the rear wall 14 and the side wall 13 of the housing 5. The locking member 16 has a top end portion which extends through the slot 15 and a lower end portion of a size such that it will not pass through the slot 17. The locking member 16 has a pair of arms 20 and 21 which extend parallel to the plane of the pivotal axis of the keeper 4 and which are within the planes of the major planar surfaces 22 and 23 (see FIG. 4) of the locking member 16. The locking member also has locking side faces 24 and 25 on the arms 20 and 21 which mate with the faces 18 and 19 when the locking member 16 is in its locking position. Preferably, the locking member 16 is made entirely of magnetic steel, but in any event, at least the top portion is made of a magnetic material for completing the magnetic circuit of the remotely and electrically energizable coil 26 and causing the locking member 16 to move upwardly when the coil 26 is energized. The coil 26 comprises wound insulated wire and a core 27 of magnetic material (see FIG. 2). The core 26 is secured at one end to a U-shaped strip 28 of magnetic material which is secured, such as by screws 28*b* and *c*, to the housing 5. The arm 28*a* of the U-shaped strip 28 is spaced from the coil 26 and the core 27 so that the locking member 16 can fit between the arm 28*a* and the coil 27 with a small clearance. Upward movement of the locking member is limited by a shoulder 16*a* (see FIG. 3) on the locking member 16 which engages the housing 5.

In the absence of electrical energization of the coil 26, the locking member 16 assumes the position shown in FIGS. 2 and 6 by reason of the force of gravity, and therefore, the magnetic pull thereon need be only sufficient to raise the locking member 16. However, if desired, a spring acting between the housing 5 and the locking member 16 can be used to return the locking member 16 to said position.

It will be observed that the locking member 16 slides in a direction perpendicular to the axis of the coil 26 and that there is only a single small air gap between the core 27 and the arm 28*a*. It has been found that such arrangement of the coil 26 and the U-shaped strip 28 provides a substantially increased magnetic pulling force as compared to the arrangement set forth in said application Ser. No. 07/555,358 now U.S. Pat. No. 4,984,835 and permits a reduction in the size of the strike.

Biassing means in the form of a spring 29 which, at one end, extends into an opening 30, (see FIGS. 4 and 5), acts between the keeper 4 and the housing side wall 13 to urge the keeper 4 into its locking position shown in FIGS. 1-4 and 6.

Figure 3:
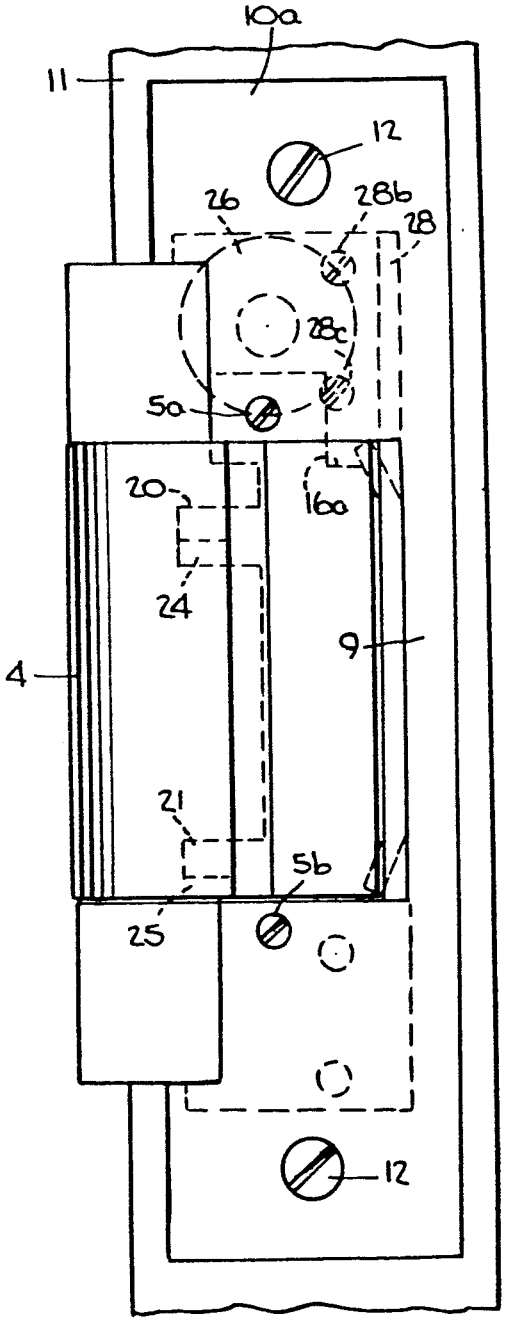

The keeper 4 has a pair of recesses 31 and 32 of a size and spacing such that when the locking member 16 is moved from the locking position, as shown in FIGS. 2, 3 and 6 to the unlocking position shown in FIG. 7, the recesses 31 and 32 receive the arms 20 and 21 and permit the keeper 4 to pivot toward the position shown in FIGS. 5 and 7 under the force applied to the door 2 to open it.

The embodiment of the strike illustrated in FIGS. 1-7 is of the normally locked type and is unlocked by electrical energization of the coil 26, electrical energy being supplied thereto by conventional wire leads (not shown).

Accordingly, as long as the locking member 16 is in its lower, keeper locking position, the door 2 is prevented from opening, but when the coil 26 is electrically energized, the locking member 26 slides rectilinearly in the upward direction to a keeper unlocking position, as illustrated in FIG. 7. In the latter position, the keeper 4 is free to pivot because the arms 20 and 21 are out of engagement with the keeper 4, the movement of the keeper 4 being shown in FIGS. 5 and 7. In FIGS. 1-4 and 6, the keeper 4 is locked, and in FIGS. 5 and 7, the keeper 4 is unlocked.

When energization of the coil 26 is discontinued, the keeper 4 is moved into its locking position by the spring 29 and the locking member 16 is returned to its locking position by the force of gravity.

It will be observed that when pressure is applied to the door 2 to open it, the latch 3 applies a pivoting force to the keeper 4 urging it toward its unlocking position. If the locking member 16 is in its locking position, such force is applied to the arms 20 and 21 by way of the faces 18 and 19 and thence, to the rear wall 14 of the housing 5. The arms 20 and 21 can be relatively sturdy and are subject to only small bending forces, and therefore, the locking member 16 can withstand relatively high forces applied thereto by a person attempting to force the door 2 open.

While the faces 19 and 20 and the faces 24 and 25 can be in planes parallel to the pivot axis of the keeper 4, if a relatively large force is applied to the door 2 in the opening direction, the pulling force of the coil 26 can be insufficient to move the locking member 16. To aid in causing the locking member 16 to move to its unlocking position with such a force, without significantly reducing the ability of the locking member 16 to resist relatively large door forces, the end faces 19, 20, 24 and 25 preferably are oppositely bevelled at an angle in the range from 10° to 15°, and preferably, about 12°, as indicated in the drawings.

It will be observed that the strike of the invention has only one moving part for locking and unlocking the keeper 4. Also, it will be observed that the locking member 16 can be readily formed from steel stock, such as by stamping, and without bending of parts thereof. Furthermore, without arms extending toward the pivot axis of the keeper 4, the depth of the strike can be reduced as compared to a locking member with arms extending toward such axis.

Since only one moving part is required for locking and unlocking of the keeper 4 and whether the keeper 4 is normally locked or unlocked depends upon the positions of the arms 20 and 21 on the locking member 16, it is a simple matter to change the strike from one in which the keeper 4 is normally locked to one in which the keeper 4 is normally unlocked by substituting a locking member with its arms differently positioned.

Figure 8:
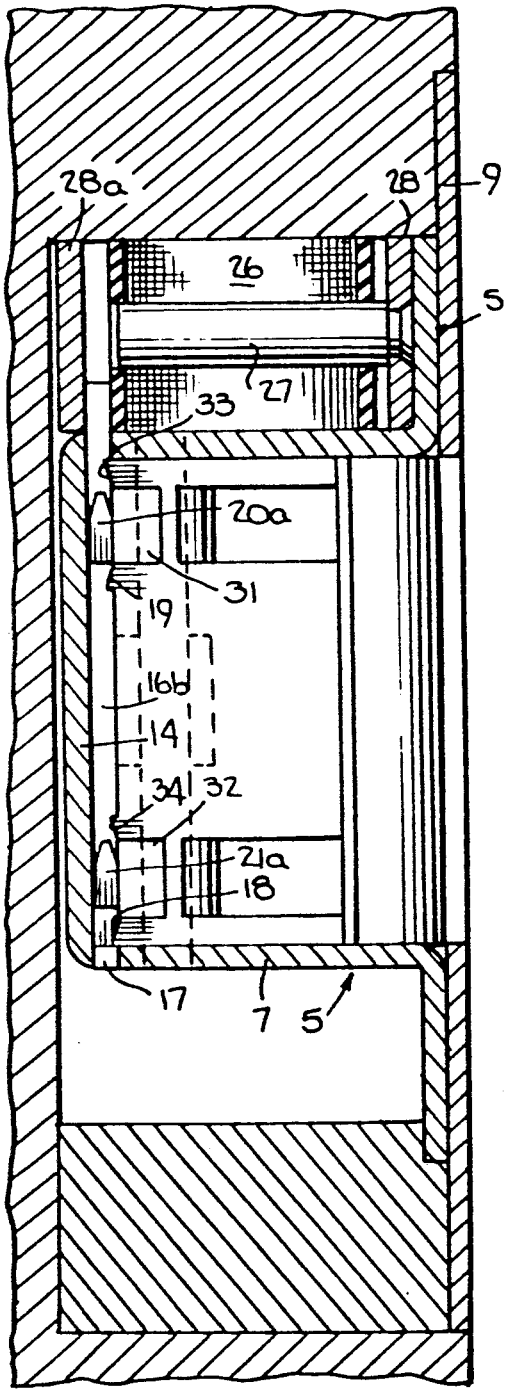
FIGS. 8 and 9 correspond to FIGS. 2 and 3 but illustrate a normally unlocked strike.
Figure 9:
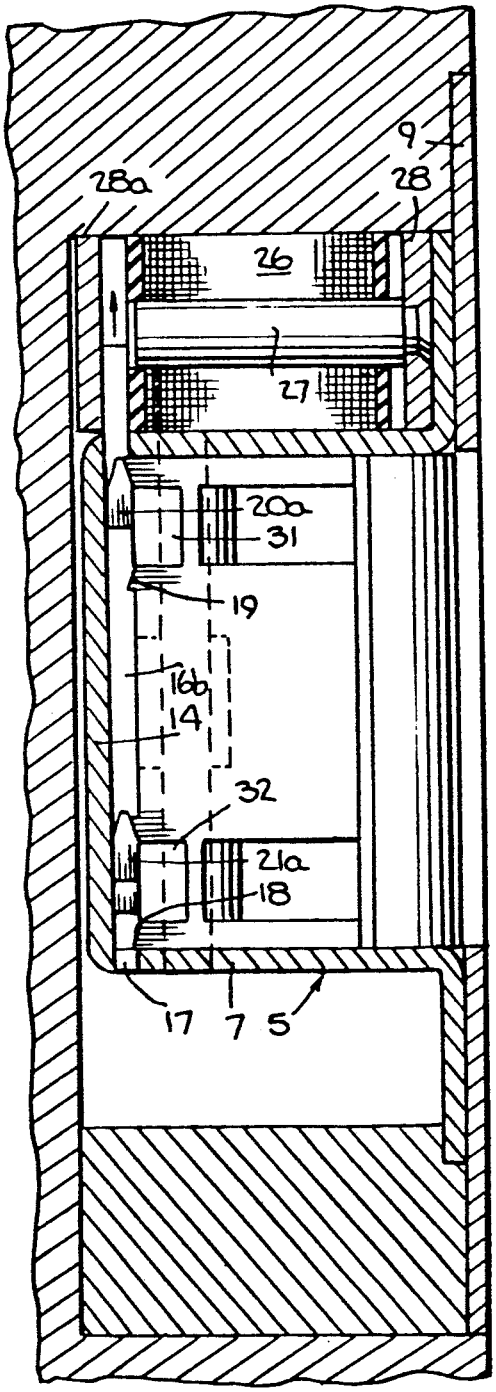

FIG. 10 illustrates a locking member 16*b* which is similar to the locking member 16 except for the positioning of the arms 20*a* and 21*a* and their faces 24*a* and 25*a*. The arms 20*a* and 21*a* are positioned thereon so that when the locking member 16*a* abuts the lower wall 7, as shown in FIG. 8, the arms 20*a* and 21*a* are out of the path of movement of the faces 18 and 19. When the coil 26 is energized, the locking member 16*a* is pulled into its locking position shown in FIG. 9, in which position, the faces 24*a* and 25*a* on the arms 20*a* and 21*a* can engage the faces 33 and 34 (FIG. 8) on the keeper 4 and prevent pivoting of the keeper 4.

Another feature of the strike of the invention, previously mentioned, is that the "hand" of the strike can be readily changed in the field without additional parts and with simple tools. Thus, assume that the door 2 is to be swung in the direction opposite to the direction indicated by the arrow 35 in FIGS. 5 and 7, the latch 3 being oppositely bevelled in such case. To change the hand of the strike 1, it is only necessary to invert the strike 1, remove the coil 26 with its U-shaped strip 28 from the position shown in FIGS. 1-3 on the housing 5 and reconnect them to the opposite end of the housing 5 and invert the locking member 16 or 16*b*. When the locking member 16 or 16*b* is inverted, its top end will then extend through the slot 17 (FIG. 2) rather than the slot 15, the slot 17 being at the top of the housing 5 when the strike 1 is inverted.

An alternative embodiment of the strike of the invention which can be normally locked or normally unlocked and which can be modified to be of either hand is illustrated in FIGS. 11-13. The alternative strike differs from the strike 1 in the disposition of the locking member faces which are engaged by the keeper surfaces and of the mating keeper surfaces.

As illustrated in FIG. 11, the keeper 4*a* has faces 18*a*, 19*a*, 33*a* and 34*a* which also lie in planes extending at a small angle to the pivot axis of the keeper 4*a* but are disposed in planes which are substantially perpendicular to the planes of the major surfaces of the locking member.

The locking member 16*c* for the alternative normally locked embodiment of the strike is shown in FIG. 12, and the locking member 16*b* for the alternative, normally unlocked embodiment of the strike, is shown in FIG. 13. The locking member 16*c* has arms 20*b* and 21*b* disposed in the same manner as the arms 20 and 21 but has end faces 24*b* and 25*b* in planes extending substantially perpendicular to the plane of the major surface 23*a* which normally is nearer the keeper 4*a* for engaging the keeper faces 18*a* and 19*a* and which lie in planes corresponding to the planes of the faces 18*a* and 19*a*, i.e. substantially perpendicular to the major surfaces 22*a* and 23*a* of the locking member 16*c*.

Similarly, the locking member 16*d* has arms 20*c* and 21*c*, and faces 24*c* and 25*c* for engaging faces 33*a* and 34*a*.

The lower portions of the locking members 16*c* and 16*d* are received in slots 17 or 15 depending on the hand of the strike.

The operation of the alternative embodiment, the manner of changing from normally locked to normally unlocked and the manner of changing "hand" is as described hereinbefore in connection with the embodiment shown in FIGS. 1-9.

Although preferred embodiments of the present invention have been described and illustrated, it will be apparent to those skilled in the art that various modifications may be made without departing from the principles of the invention.

We claim:

1. A strike comprising:

a housing with a plurality of walls;

a keeper pivotally mounted on said housing for pivoting movement around a pivot axis from a first position to a second position for respectively engaging a latch and moving away from the latch, said keeper having at least one face spaced from said axis and which lies in a plane substantially parallel to said axis;

a locking member slidably mounted on said housing intermediate said face and a wall of said housing, said locking member being a substantially flat plate which is long relative to its width, which is rectilinearly slidable in its length direction and in directions substantially parallel to said pivot axis and which has a thickness dimension which is transverse to its length and width, a pair of major surface in planes defining said thickness and at least one arm extending substantially parallel to said planes of said major surfaces and within said planes, said arm having a locking face within said planes, which in one position of said locking member, is engageable and mates with said face of said keeper for preventing pivoting of said keeper and which, in another position of said locking member, is out of engagement with, and out of the path of movement of, said face of said keeper for permitting pivoting of said keeper;

biassing means acting between said keeper and said housing and urging said keeper into said first position thereof; and locking member actuating means for moving said locking member from one said position thereof into another said position thereof.

2. A strike as set forth in claim 1 wherein said locking member actuating means is an electrically energizable coil and said locking member has a magnetic portion adjacent but spaced from said coil which is urged toward said coil by the magnetic field thereof when said coil is electrically energized.

3. A strike as set forth in claim 1 wherein said face of said keeper and said locking face have interengaging surfaces which lie in planes extending at an angle of less than about 15° to said keeper pivot axis.

4. A strike as set forth in claim 1 wherein said plane of said face of said keeper is substantially parallel to the plane of the one of said major surfaces nearer said keeper when said keeper is in said first position thereof.

5. A strike as set forth in claim 4 wherein said plane of said face of said keeper is at an angle of less than 15° to the plane of said major surfaces nearer said keeper.

6. A strike as set forth in claim 4 wherein said arm has a side face which is an extension of said one of said surfaces and said locking face is on said side face.

7. A strike as set forth in claim 1 wherein said arm has an end face in a plane extending substantially perpendicularly to the plane of the one of said major surfaces nearer said keeper, said locking face is on said end face and said plane of said face of said keeper is substantially perpendicular to a plane of said one major surface when said keeper is in said first position thereof.

8. A strike as set forth in claim 7 wherein the plane of said end face and the plane of said face of said keeper extend at an angle of less than 15° to said pivot axis.

9. An electrically operable device comprising a magnetic member movable in a plane and an electromagnet for moving said member in said plane, said electromagnet comprising a coil of wire wound around a coil axis, a coaxial magnetic core and a U-shaped magnetic strip having a base portion and a pair of arms, one of said arms being at one end of said base portion and the other of said arms being at the other end of said base portion and both of said arms extending transversely to said base portion, said U-shaped magnetic strip having one of its arms in engagement with said core at one end thereof and the other of its arms spaced from the other end of said core for receiving a portion of said magnetic member, said coil axis being disposed substantially perpendicularly to said plane with said portion of said magnetic member between said other of said arms of said strip and said other end of said core.

10. An electrically operable device as set forth in claim 9 wherein said magnetic member is rectilinearly slidable in said plane.

11. An electrically operable device as set forth in claim 10 wherein said magnetic member is a flat plate which is long relative to its width, which has a thickness dimension which is transverse to its length and width and which has a pair of major surfaces in planes defining said thickness and comprises at least one arm extending parallel to the plane of at least one of said major surfaces.

12. An electrically operable device as set forth in claim 11 further comprising a pivotable keeper having a face engageable with said arm in one position thereof, said arm being out of the path of movement of said face in another position thereof.

13. A strike comprising:

a housing with a plurality of walls;

a keeper pivotally mounted on said housing for pivoting movement around a pivot axis from a first position to a second position for respectively engaging a latch and moving away from the latch, said keeper having at least one face spaced from said axis and which lies in a plane substantially parallel to said axis;

a locking member slidably mounted on said housing intermediate said face and a wall of said housing, said locking member being a substantially flat plate which is long relative to its width, which is rectilinearly slidable in its length direction and in directions toward and away from said face, and which has a thickness dimension which is transverse to its length and width, a pair of major surfaces in planes defining said thickness, and at least one arm extending substantially parallel to said planes of said major surfaces and within said planes, said arm having a locking face within said planes which, in one position of said locking member, is engageable and mates with said face of said keeper for preventing pivoting of said keeper and which, in another position of said locking member, is out of engagement with, and out of the path of movement of, said face of said keeper for permitting pivoting of said keeper;

biassing means acting between said keeper and said housing and urging said keeper into said first position thereof; and locking member actuating means for moving said locking member from one said position thereof into another said position thereof.

14. A strike comprising:

a housing with a plurality of walls;

a keeper pivotally mounted on said housing for pivoting movement around a pivot axis from a first position to a second position for respectively engaging a latch and moving away from the latch, said keeper having at least one face spaced from said axis and which lies in a plane substantially parallel to said axis;

a locking member slidably mounted on said housing intermediate said face and a wall of said housing, said locking member being a substantially flat plate which is long relative to its width, which is rectilinearly slidable in its length direction and in directions substantially parallel to said pivot axis and which has a thickness dimension which is transverse to its length and width, a pair of major surfaces in planes defining said thickness and at least one arm extending substantially parallel to said planes of said major surfaces and within said planes, said arm having a locking face within said planes which, in one position of said locking member, is engageable and mates with said face of said keeper for preventing pivoting of said keeper and which, in another position of said locking member, is out of engagement with, and out of the path of movement of, said face of said keeper for permitting pivoting of said keeper;

biassing means acting between said keeper and said housing and urging said keeper into said first position thereof; and locking member actuating means for moving said locking member from one said position thereof into another said position thereof, said locking member actuating means comprising a coil of wire wound around a coil axis, a coaxial magnetic core and a U-shaped magnetic strip having a base portion and a pair of arms, one of said arms being at one end of said base portion and the other of said arms being at the other end of said base portion and both of said arms extending transversely to said base portion, said U-shaped magnetic strip having one of its arms in engagement with said core at one end thereof and the other of its arms spaced from the other end of said core for slidably receiving a portion of said locking member therebetween, said coil being mounted on said housing with said coil axis substantially perpendicular to the direction of sliding movement of said locking member and with said portion of said locking member between said other of the arms of said strip and said other end of said core and said portion of said locking member being magnetic and being adjacent but spaced from said coil and being urged toward said coil by the magnetic field thereof when said coil is electrically energized.

15. A strike comprising:

a housing with a plurality of walls;

a keeper pivotally mounted on said housing for pivoting movement around a pivot axis from a first position to a second position for respectively engaging a latch and moving away from the latch, said keeper having at least one face spaced from said axis and which lies in a plane substantially parallel to said axis;

a locking member slidably mounted on said housing intermediate said face and a wall of said housing, said locking member being a substantially flat plate which is long relative to its width, which is rectilinearly slidable in its length direction and in directions substantially parallel to said pivot axis and which has a thickness dimension which is transverse to its length and width, a pair of major surfaces in planes defining said thickness and at least one arm extending substantially parallel to said planes of said major surfaces and within said planes, said arm having a locking face within said planes which, in one position of said locking member, is engageable and mates with said face of said keeper for preventing pivoting of said keeper and which, in another position of said locking member, is out of engagement with, and out of the path of movement of, said face of said keeper for permitting pivoting of said keeper, said housing having a wall extending in a plane substantially parallel to the length of said arm and said locking member being in contact with said wall of said housing;

biassing means acting between said keeper and said housing and urging said keeper into said first position thereof; and locking member actuating means for moving said locking member from one said position thereof into another said position thereof.

* * * * *